United States Patent [19]

Saligny

[11] Patent Number: 4,618,204

[45] Date of Patent: Oct. 21, 1986

[54] CONNECTION DEVICE

[75] Inventor: Yves Saligny, Cluses, France

[73] Assignee: Carpano & Pons, France

[21] Appl. No.: 622,388

[22] Filed: Jun. 20, 1984

[30] Foreign Application Priority Data

Dec. 5, 1980 [FR] France ..... 80 26161

[51] Int. Cl.[4] ..... H01R 9/24

[52] U.S. Cl. ..... 339/99 R; 339/198 R; 339/210 M

[58] Field of Search ..... 339/49 R, 49 B, 97 R, 339/97 P, 98, 99 R, 198 R, 198 H, 198 S, 204, 205, 206 R, 206 P, 207 R, 210 R, 210 M

[56] References Cited

U.S. PATENT DOCUMENTS

| | | | |
|---|---|---|---|
| 2,392,438 | 1/1946 | Wade | 339/205 |
| 3,112,974 | 12/1963 | Curtis et al. | 339/49 R |
| 3,482,201 | 12/1969 | Schneck | 339/206 R |
| 3,745,512 | 7/1973 | Johnson et al. | 339/59 M |
| 3,858,163 | 12/1974 | Goodman et al. | 339/206 R |
| 3,945,705 | 3/1976 | Seim et al. | 339/210 M |
| 4,106,837 | 8/1978 | Paluch | 339/98 |
| 4,330,164 | 5/1982 | Pittman et al. | 339/49 R |

FOREIGN PATENT DOCUMENTS

| | | | |
|---|---|---|---|
| 2309236 | 8/1974 | Fed. Rep. of Germany | 339/99 R |
| 2416565 | 8/1979 | France . | |
| 7512702 | 5/1977 | Netherlands | 339/98 |
| 644540 | 10/1950 | United Kingdom | 339/198 H |
| 2037096 | 7/1980 | United Kingdom | 339/97 P |

OTHER PUBLICATIONS

AMP advertisement 478-10M-pp. 4-63, Apr. 1963, "Dualatch Connectors".

*Primary Examiner*—Gil Weidenfeld
*Assistant Examiner*—Gary F. Paumen
*Attorney, Agent, or Firm*—Darby & Darby

[57] ABSTRACT

A connection device, in particular for telecommunication lines, comprises a casing consisting of two substantially identical parts, each comprising, on their open assembly side, a plurality of projecting parts and recessed parts in the form of castellations. The dimensions of the castellations are such that they are able to penetrate one in the other. A passage is contained in each projection of one part of the casing and in the corresponding recess in the other part of the casing. Each passage contains two conductor elements arranged in facing relationship. The elements have split end parts arranged on opposite sides of the casing, into which electrical connections can be made.

9 Claims, 10 Drawing Figures

19-19'
20-20'
IV
IV
1
2
3
4
5
6
7
8
11
14
15
16
17
18
22
26'
28

19-20
19'-20'
III
III'
III'
III
3
8
11
12
14
14'
16
26
26'
28

19-19'
20-20'
1
2
3
4
5
6
7
7'
14'
15'
16
17
18
21
22

19-20
19'-20'
3
8
11
12
14
14'
21
22
23
24
27
28

CONNECTION DEVICE

This is a continuation, of application Ser. No. 324,020 filed Nov. 23, 1981, now abandoned.

BACKGROUND OF THE INVENTION

The present invention relates to connection devices, in particular for telecommunication lines, comprising conductor elements arranged side by side parallel to each other, each split at one end in order to receive a linewire, the conductor elements being retained axially between the two assembled parts of an insulating casing and constituting two alignments, rows or arrays arranged in facing relationship in said casing. The split end parts of the plugs are arranged in the direction of the longitudinal side of one of the parts of the casing, on the side opposite the open assembly side of said part of the casing. The longitudinal side of the casing comprises, on the one hand, driving or guiding slots provided opposite the slots of the end parts, transversely with respect to said longitudinal side and opening out on the two side faces adjacent said longitudinal side and on the other hand, access slots, passing through the same longitudinal side of the casing, longitudinally between the two alignments of split end parts of conductor elements.

In known connection devices of this type, such as that described in the French Application for a Certificate of Addition No. 2 416 565, the conductor elements are relatively close to each other in the casing and in particular in order to allow sufficient insulation between these conductor elements, in particular in the vicinity of the interface between the two parts of the casing, it has been necessary to tilt the conductor elements by an angle of 45°, whilst keeping them parallel to each other, which has made it possible to increase the air gap which separates them. The result of this is that if the dimension of the device is relatively small in the direction of the alignments of conductor elements, its dimension is consequently increased in the transverse direction with respect to the former and the entire connection device thus has a greater bulk. In addition, since the input and output of each line-wire are connected respectively to two conductor elements arranged opposite each other, one forming part of one alignment and the other forming part of the other alignment, it is thus absolutely necessary to use two conductor elements on each alignment, in order to connect the two wires of a line, which with an equal number of lines tends to increase the length of the connection device. On the other hand, means are not provided for possibly effecting the disconnection of the wires of all the lines quickly and in a single operation, in order to connect them immediately in a different manner. This is the case for example when it is necessary to disconnect all the output wires of a connection device, in order to connect them instantaneously to the input wires of another connection device. In the device of the prior art, an operation of this type would make it necesary to disconnect each output wire one by one from the slot in which it is held and to reconnect the latter in the slot of a conductor element forming part of another connection device, to which the input wires are already connected.

SUMMARY OF THE INVENTION

The connection device to which the invention relates is characterised in that the second part of the casing also contains conductor elements of which the respective split end parts are arranged in the opposite direction to those of the other part of the casing. These conductor elements are arranged in two alignments as in this other part. The longitudinal side of the second part of the casing still also comprises driving slots and access slots similar to those of the other part of the casing. These access slots in the second part of the casing may in certain cases be dispensed with.

Furthermore, the split end parts of the conductor elements of the two parts of the casing are arranged respectively in parallel planes, parallel to the alignments of said conductor elements. In addition, the casing comprises passages arranged side by side parallel to each other and the dimensions of which are suitable for receiving, at each end, at the most two conductor elements arranged opposite each other, one forming part of one alignment, the other forming part of the other alingment, each passage extending in the two parts of the casing, its continuity being ensured by inter-engagement of the two parts of the casing.

According to one embodiment, the two parts of the casing are substantially identical and each comprise, on their open assembly side, a plurality of parts which are alternately projecting parts and recessed parts, in the form of castellations, the dimensions of which are such that they are able to penetrate one in the other. One passage, or in certain cases two parallel passages are contained in each projecting part of one of the parts of the casing and in its extension in the other part of said casing.

According to another embodiment, the continuity of each passage is ensured by engagement of the end of one half-passage in the end of the following half-passage.

According to certain embodiments, the two parts of the casing are assembled permanently, after the positioning of the conductor elements which they contain.

According to other embodiments, the two parts of the casing can be disconnected, at the same time as the conductor elements which they respectively contain.

The present invention provides a connection device which, whilst having improved insulation between its conductor elements, has a simple and compact construction and is polyvalent. That is, it makes it possible to provide very different internal connection combinations, whilst retaining the possibility of gaining access to line-wires inside the casing. For example it possiblly allows virtually instantaneous disconnection of the input wires of all the lines from the connection device, in order to connect immediately to the corresponding output wires of all the lines, other input wires already connected to another connection device. One particularly advantageous variation of the device makes it possible to drive all the line-wires respectively into all the corresponding clamping slots, in a single operation and then to keep each of the wires in position in its slot, whilst improving the insulation there-between of the connections produced in this way.

BRIEF DESCRIPTION OF THE DRAWINGS

The accompanying drawings illustrate embodiments according to the present invention, by way of example.

DESCRIPTION OF THE PREFERRED EMBODIMENTS

Figure 3:
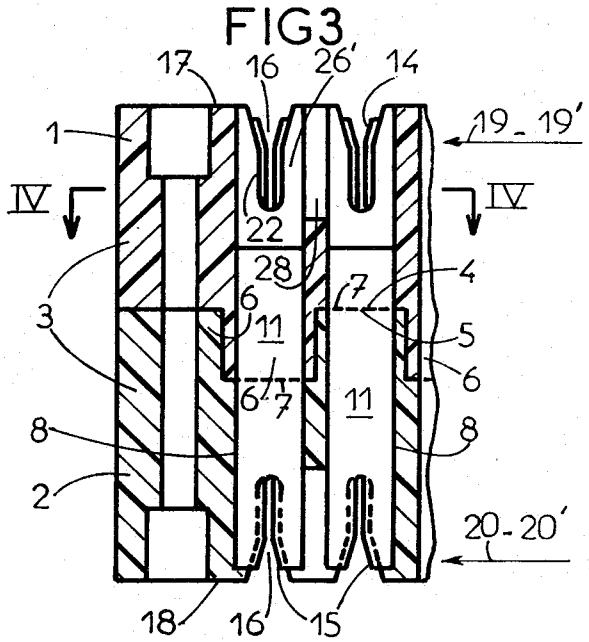
FIG. 3 shows the same first embodiment, in elevation/section, the part 1 of the casing being viewed along line III—III of FIG. 4 and the part 2 of the casing being viewed along line III'—III' of FIG. 4.
Figure 4:
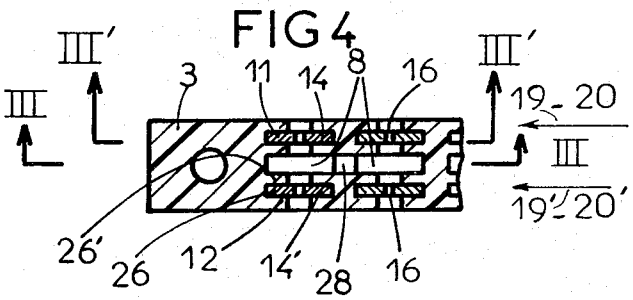
FIG. 4 shows the same first embodiment, viewed in section on line IV—IV of FIG. 3.

As illustrated in FIGS. 1 to 4, the connection device comprises an insulating casing 3 comprising two parts 1 and 2 which in this example are identical and each comprise on their open assembly side respectively 4 and 5, a plurality of alternating parts, namely projecting parts or merlons 6 and recessed parts or crenels 7, in the form of castellations, the dimensions of which are such that they are able to inter-engage, the crenels or recesses of one part being opposed to the merelons or projections of the other part. Each projecting part 6 and its extension 7' in the other part of the casing 3 (FIG. 1) contain a passage 8 (FIG. 3). In this example, each passage 8 has a rectangular cross section. Each passage 8 moreover contains two conductor elements 11 and 12 arranged face to face against two opposite walls of said passage 8. In this example, the two conductor elements 11 and 12 are rectilinear i.e. straight. At each end they respectively comprise end parts 14,14' and 15,15' each provided with a slot 16 into which a line-wire is to be driven. The split end parts 14 and 14' are arranged in the opposite direction to the end parts 15,15' located in the other part 2 of the casing 3. Since the passages 8 are arranged side by side parallel to each other, the split end parts 14,14' on the one hand, 15,15' on the other hand, respectively define on the two longitudinal sides 17 and 18 of the casing 3, alignments respectively 19, 19' and 20,20'. The split end parts 14,14', 15,15' of the conductor elements 11 and 12 are arranged respectively parallel to the directions 19,19',20,20' of said conductor elements.

Figure 1:
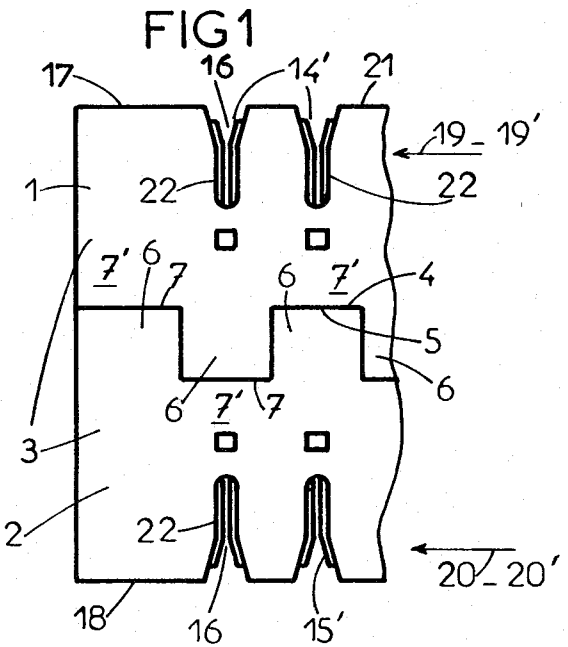
FIG. 1 is a view in elevation of an end part of a first embodiment of the invention.

The free ends of the split end parts 14,14'-15,15' are set back or recessed with respect to the longitudinal sides 17 and 18 of the casing 3. In this example, these end parts are housed in sockets 26 (FIGS. 3-4) the walls of which closely follow the profile of each of the split ends parts, as far as the immediate vicinity of each slot 16. Each socket 26 is provided between the outer wall of each passage 8 and a partition 26', of limited height, parallel to said wall. The socket 26 and the partition 26' are also visible particularly in FIG. 7. Each socket 26 also comprises two insulating partions 21 in the form of bridges (FIG. 2), covering the two sides of the free ends of the split end parts 14,14'-15,15'. These bridges 21 are simply portions of the side 17 or 18 which remain intact and retain the conductor elements 11,12 in their passage 8, thus preventing any axial displacement of said elements as soon as the two parts of the casing 3 are fitted one in the other (FIGS. 1 and 3).

Figure 2:
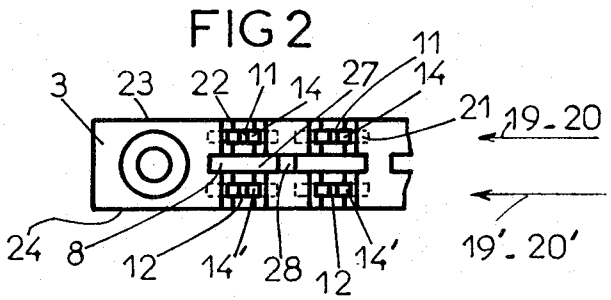
FIG. 2 shows the first embodiment as a plan view of FIG. 1.

Driving or guiding slots 22 are provided transversely with respect to each of the longitudinal lateral sides 17-18 and opening out on the two side faces 23 and 24 adjacent said longitudinal sides (FIG. 2).

Access slots 27 are provided through the two longitudinal sides 17 and 18 of the casing 3, longitudinally between the alignments 14 and 14' on the one hand and 15 and 15' on the other hand (FIG. 2). Between two successive passages 8, the common wall is thus eliminated at 28 (FIG. 3) over a height substantially equal for example to the depth of the slots 16. These slots 27 are provided in order to facilitate the introduction of various members, either insulating members or test members, intended to cooperate with certain extensions of the conductor elements housed in each passage 8 and possibly to modify the electrical circuit within the casing 3.

Access slots 27 are not used in the embodiment according to FIGS. 1 to 4, in which the conductor elements 11 and 12 are rectilinear, no connection being provided there-between.

In the embodiment according to FIGS. 1 to 4, the connection device is used as a terminal block or connecting slide block without cut-off. The split end parts 15 and 14 (FIG. 3) of the conductor element 11 respectively constitute the input and output terminals of one of two wires of a line. The split end parts 15' and 14' (FIG. 1) of the conductor element 12 respectively constitute the input and output terminals of the second wire of the same line.

Figure 5:
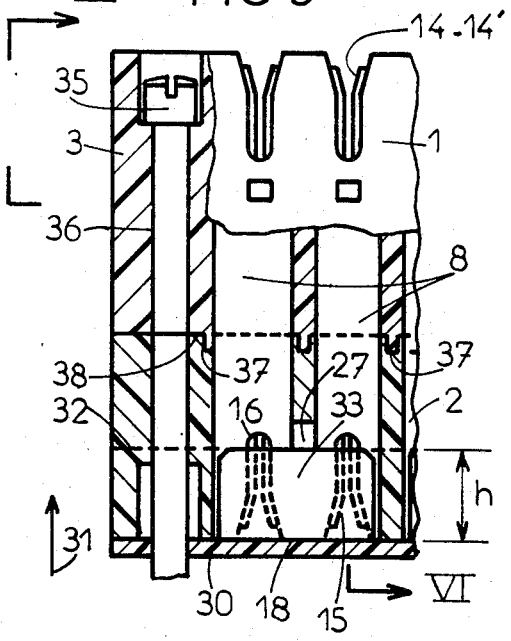
FIG. 5 shows a second embodiment of the invention, viewed partially in section along line V—V of FIG. 6.
Figure 6:
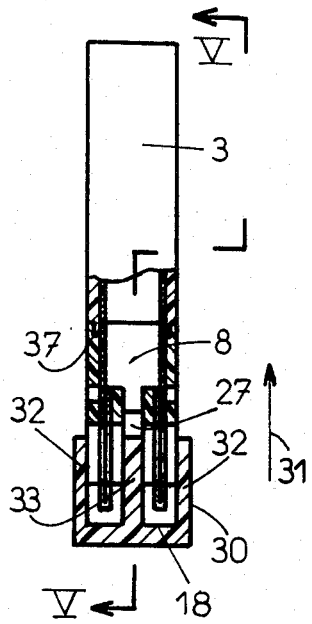
FIG. 6 shows the same second embodiment, viewed partially in section along line VI—VI of FIG. 5.

According to a second embodiment, illustrated in FIGS. 5 and 6, one of the longitudinal sides, for example 18, of the casing 3 is provided with an insulating connecting member 30, which can be inserted in the direction 31 of the access slots 27. This connection member 30 comprises two insulating side cheeks 32 arranged respectively on either side of the casing 3. It also comprises, for example, a succession of insulating strips 33 parallel to the side cheeks 32, the dimensions of which are such that they are housed respectively in the access slots 27. The height h of the side cheeks 32 and of the strip 33 is advantageously less than the depth of the slots 16 of the end parts 14,14'15,15' of the conductor elements. In the example described (FIGS. 5 and 6), the length of each access slot 27 is substantially equal to the width of two passages 8 and the same is true for each strip 33.

When the wires are driven into the slots 16, the wires are all located in the conical entrance of their respective slots. The connection member 30 is then introduced in the direction of arrow 31 and force-fitted in its position shown in FIGS. 5 and 6, using two screws 35 for example housed in orifices 36 provided at the two ends of the casing 3, transversely with respect to the two parts 1 and 2 of the latter. These screws 35 pass through these two parts 1 and 2 and are engaged for example with a support which is not shown in the drawing, but is located below the connection member 30 (FIGS. 5 and 6). All the wires which are intended to be inserted into their respective slots 16 are thus inserted in one operation. They are retained in the latter subsequently and their insulation is improved by the cheeks 32 and the strips 33.

Without diverging from the scope of the present invention, the connection member 30 could be produced in several parts, each of them corresponding for example to one or more pairs of passages 8.

Subsequently, each connection member 30 can be removed from its casing 3, for example in order to disconnect one or more wires and connect others in their place. A new positioning operation of the connection member 30 in the direction of arrow 31 would bring about driving-in of these other wires.

FIGS. 5 and 6 also show a second embodiment of the casing 3. The parts 6 and 7 in the form of castellations of the first embodiment (FIGS. 1 to 4) are dispensed with. The interface 38 between the two parts 1 and 2 of the casing 3 is substantially flat and the part 1 comprises on the periphery of each passage 8 a projecting tongue 37 which is provided to fit in the end of the half-passage 8 which follows it.

Figure 7:
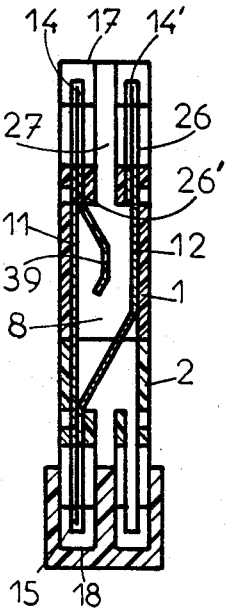
FIGS. 7 to 10 respectively show four variations of the conductor elements of the connection devices according to the present invention.

In the variation illustrated in FIG. 7, the two conductor elements 11,12 respectively comprising the split end parts 14,14', arranged opposite each other on the longitudinal side 17 of the same part 1 of the casing 3, constitute the same conductor element, approximately of Y shape, comprising a single split part 15 supported by the other part 2 of the casing 3. The split end part 15' is dispensed with, the conductor element 12 being connected to the conductor element 11. A curved extension 39 of the conductor element 11 is able to cooperate with a test member, which may be introduced into the access slot 27.

An input wire may thus be connected at 15 and two output wires respectively at 14 and 14'. For example, an output wire previously connected at 14, may be replaced by a wire connected at 14', both being able to be connected together momentarily in order to prevent the line from being cut-off.

Figure 8:
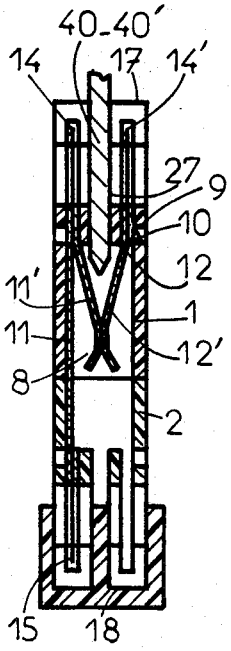

In the variation illustrated in FIG. 8, the respective split end parts 14 and 14' of the two conductor elements 11,12 arranged in facing relationship on the longitudinal side 17 of the part 1 of the casing respectively comprise, inside the casing, curved extensions 11',12' cooperating elastically with each other, whereof the point of contact is arranged substantially in alignment with the access slot 27. The split end part 14 forms part of the same conductor element 11 as the split end part 15 arranged on the longitudinal side 18 of the part 2 of the casing.

When an input wire is connected at 15, it is possible to connect output wires at 14 or 14'. In the first case, a test member 40 may be introduced into the access slot 27 in order to test the line. In the second case, an insulating member 40' may be introduced into the slot 27 in order to interrupt the line.

Figure 9:
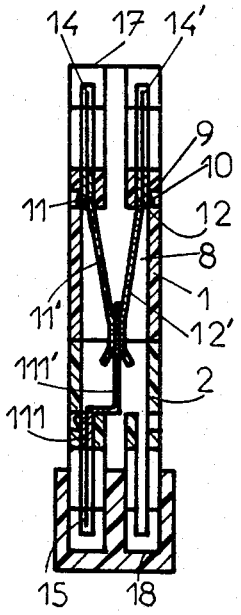

In the variation shown in FIG. 9, the two parts 1 and 2 of the casing can be disconnected. The respective split end parts 14,14' of the two conductor elements 11,12 arranged in facing relationship on the longitudinal side 17 of the same part 1 of the casing, respectively comprise, inside the casing, extensions 11',12' curved one towards the other, cooperating elastically respectively with the two opposite sides of a third extension 111' which forms part of a conductor element 111 for example, whereof the split end part 15 is arranged on the longitudinal side 18 of the other part 2 of the casing.

An input wire may be connected at 15 and output wires at 14 and/or at 14'. The connection device is thus used as a cutoff strip in a telephone distributor. By disconnecting the part 2 of the casing from part 1, the device makes it possible to disconnect all the input wires connected to the device instantaneously and to re-connect other input wires connected to another connection device, by connecting the part 2 of the casing of this other connection device, in a single operation.

Figure 10:
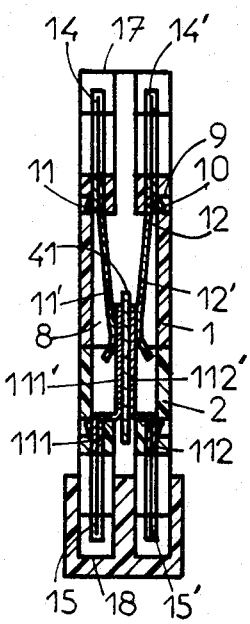

In the variation illustrated in FIG. 10, the two parts 1 and 2 of the casing can also be disconnected. The respective split end parts 14,14' of the two conductor elements 11, 12 arranged in facing relationship on the longitudinal side 17 of the same part 1 of the casing respectively comprise, inside the casing, extensions 11',12', curved for example one toward the other, cooperating elastically respectively with two other extensions 111',112' respectively forming part of conductor elements 111,112, whereof the respective end parts 15,15' are arranged in facing relationship on the longitudinal side 18 of the other part 2 of the casing. An insulating part 41 is advantageously located respectively between the extensions 11,111 and 12,112.

In this case, an input wire can be connected at 15, the corresponding output wire being connected at 14. Similarly, an input wire is connected at 15' and the corresponding output wire is connected at 14'. The two wires of the same line are thus connected in the same passage 8. The entire part 2 of the casing may be disconnected and another part 2 connected in its place, as described in the case of FIG. 9.

It will be noted that the inner walls of the passages 8 respectively comprise, at each end of the latter, notches 9 arranged in alignment on the two side faces adjacent the longitudinal sides 17,18 of the two parts 1 and 2 of the casing 3. In certain cases, these notches serving solely for positioning the conductor elements 11,12 axially for example, when the latter do not extend from one end to the other of the passage 8. This is the case in the variations according to FIG. 8 to 10. The conductor elements thus comprise lugs 10 which are respectively housed in the notches 9. Other solutions may also be adopted for retaining the conductor elements 11,12,111,112 axially.

The invention may be embodied as a limiter, cut-off slide, cable head or, in general, as any kind of connection device, particularly in a telecommunication line . .

What is claimed is:

1. A connection device, in particular for telecommunication lines, comprising an insulating casing formed in two detachably assembled parts, the casing parts being adapted to be readily connected and disconnected to effect the simultaneous connection and disconnection of a plurality of electrical line-wires, each casing part including a longitudinal side and an open assembly side, and having on the open assembly side a plurality of alternating projecting parts and recessed parts in the form of castellations, the dimensions of the projecting parts and recessed parts being such that they are able to penetrate one in the other, a plurality of elongated, two-ended conductor elements arranged side-by-side in opposite pairs parallel to each other, each conductor element being split at its opposite ends to receive a line-wire an being retained axially between said two parts, said split ends being recessed within said casing an respectively forming arrays substantially in between and parallel to the outer longitudinal sides of said respective parts, each of said longitudinal sides being formed with bridges overlying said conductor elements for retaining said conductor elements and with driving slots aligned with said respective split ends and being further formed with access slots disposed between said respective split ends, said casing being formed with passages arranged side by side, parallel to each other, the dimensions of which are such that they are able to receive said conductor elements, each projecting part of each casing part having formed therein a portion of one of said passages so that said passages extend continuously through the casing parts, the conductor elements being arranged so that each castellation contains only one opposite pair of conductor elements to provide an increased electrical leakage path between adjacent opposite pairs of the conductor element.

2. A connection device according to claim 1, wherein the passages comprise sockets at their two opposite ends provided for receiving the split end parts of two conductor elements, the walls of said sockets closely following the profile of each of the two split end parts in the immediate vicinity of each slot.

3. A connection device according to claim 1 wherein at least one of the longitudinal sides of the casing is provided with at least one insulating connection member, this connection member comprising two insulating side cheeks arranged respectively on either side of the casing and at least one insulating strip, parallel to the cheeks and the dimensions of which are such that it can be housed in the access slot, the height of the cheeks and of the strip being slightly less than the depth of the slots of the end parts of the conductor elements.

4. A connection device according to claim 1 wherein the respective split end parts of two conductor elements arranged in facing relationship on the longitudinal side of the same part of the casing respectively form part of the same conductor elements as do the split end parts arranged in facing relationship on the longitudinal side of the other part of the casing.

5. A connection device according to claim 1 wherein said conductor elements, respectively comprising the end parts arranged in facing relationship on the longitudinal side of the same part of the casing, one forming part of one alignment and the other forming part of another alignment, are connected to form a conductor element substantially of Y shape, comprising a single split end part contained within the other part of the casing.

6. A connection device according to claim 1 wherein the respective split end parts of two conductor elements, arranged in facing relationship on the longitudinal side of the same part of the casing, one forming part of an alignment, the other forming part of another alignment, respectively comprise, inside the casing, curved extensions cooperating elastically together, whereof the point of contact is arranged in alignment with the corresponding access slot and in that one of these split end parts forms part of the same conductor elementas a split end part arranged on the longitudinal side of the other part of the casing.

7. A connection device according to claim 1 wherein the two parts of the casing can be disconnected and in that the respective split end parts of two conductor elements arranged in facing relationship on the longitudinal side of the same part of the casing, one forming part of an alignment, the other forming part of another alignment, respectively comprise, inside the casing, extension curved one towards the other, cooperating elastically with the two opposite sides respectively of a third extension which forms part of at least one of the conductor elements whereof the respective split end parts are arranged on the longitudinal side of the other part of the casing.

8. A connection device according to claim 1 wherein the two parts of the casing can be disconnected and in that the respective split end parts of two conductor elements arranged in facing relationship on the longitudinal side of the same part of the casing, one forming part of an alignment, the other forming part of another alignment, respectively comprise, inside the casing, extensions cooperating elastically respectively with two other extensions, further comprising an insulating part arranged in the alignment of the corresponding access slot and separating said extensions, these two other extensions respectively forming part of the conductor elements whereof the split end parts are arranged in facing relationship on the longitudinal side of the other part of the casing, one forming part of one alignment and the other forming part of the other alignment.

9. A connection device, in particular for telecommunication lines, comprising:

an insulating casing formed in two detachably assembled parts, the parts being substantially identical in structure, each part including an outer longitudinal side and an open assembly side, and having on the open assembly side a plurality of alternating projecting portions and recessed portions in the form of castellations, the projecting portions of one part being aligned with the recessed portions of the other part to allow the parts to be matingly interconnected axially, each part having a passage formed in each of its projecting portions and recessed portions, the passages of the projecting portions and recessed portions of one part being aligned with the passages of corresponding mating projecting portions and recessed portions of the other part;

a plurality of elongated, two ended conductor elements, the conductor elements extending axially through the casing and being arranged in parallel rows of opposite pairs, each opposite pair of elements being received by the aligned passages of the corresponding mating projecting portions and recessed portions of the casing parts so that each castellation contains only one opposite pair of conductor elements, each element being split at its opposite ends to receive a line-wire and being retained axially between the casing parts, the split ends being recessed within the casing from the outer longitudinal sides of the casing parts, each casing part including bridges formed on its outer longitudinal side, the bridges partially overlying the conductor elements for retaining the conductor elements within the casing;

each casing part including driving slots formed on its outer longitudinal side, the driving slots being aligned with the split ends of corresponding conductor elements; and each casing part including sockets formed in proximity to its outer longitudinal side, each socket of each part being dimensioned to receive a corresponding split end of a conductor element.

* * * * *